US005666132A

United States Patent [19]

Ochi et al.

[11] Patent Number: 5,666,132

[45] Date of Patent: Sep. 9, 1997

[54] LIQUID CRYSTAL DISPLAY

[75] Inventors: Isao Ochi, Tokorozawa; Takashi Akiyama, Sayama, both of Japan

[73] Assignee: Citizen Watch Co., Ltd., Tokyo, Japan

[21] Appl. No.: 525,624

[22] PCT Filed: Jan. 24, 1995

[86] PCT No.: PCT/JP95/00080

§ 371 Date: Sep. 22, 1995

§ 102(e) Date: Sep. 22, 1995

[87] PCT Pub. No.: WO95/20209

PCT Pub. Date: Jul. 27, 1995

[30] Foreign Application Priority Data

Jan. 24, 1994 [JP] Japan ..... 6-005877

[51] Int. Cl.[6] ..... G09G 3/36

[52] U.S. Cl. ..... 345/96; 345/209

[58] Field of Search ..... 345/94, 99, 89, 345/96, 209

[56] References Cited

U.S. PATENT DOCUMENTS 5,229,761 7/1993 Fase ..... 345/99
5,438,431 8/1995 Ostromoukhov ..... 358/457

FOREIGN PATENT DOCUMENTS 63-74036 4/1988 Japan .
1-273094 10/1989 Japan .
2-12123 1/1990 Japan .
5-323283 12/1993 Japan .

*Primary Examiner*—Mark R. Powell
*Attorney, Agent, or Firm*—Finnegan, Henderson, Farabow, Garrett and Dunner, L.L.P.

[57] ABSTRACT

An LCD displays an image having gradations according to a dithering technique. The LCD is capable of canceling a direct-current voltage applied to a liquid crystal panel of the LCD. The LCD has an A-D converter for achieving a dithering operation according to reference voltage pairs that are switched from one to another. The LCD employs a phase control signal 20 to control the phase of the dithering operation. The logic value of the phase control signal 20 is changed to switch the reference voltage pairs with respect to a given one of the polarities of a LCD driving voltage applied to the panel. When data provided by the A-D converter involve different gradations, a voltage difference is generated between the LCD driving voltages of different polarities. This voltage difference produces a direct-current voltage in the panel. The present invention cancels the generated direct-current voltage, to prevent images from being stuck into the panel.

4 Claims, 7 Drawing Sheets b1
(1000)

e2 a2 e1 a1
(0111)
(0110)

LIQUID CRYSTAL DISPLAY

BACKGROUND OF THE INVENTION

1. Field of the Invention

The present invention relates to a liquid crystal display (LCD) for displaying a gray-scale image, and particularly, to an LCD that displays a gray-scale image according to image data quantized by an analog-to-digital (A-D) converter.

2. Description of the Related Art

Television sets employing LCDs usually have A-D converters to digitize analog image signals. A simple-matrix LCD for displaying dynamic images converts an analog luminance signal into a digital signal and carries out pulse-width modulation on the digital signal. The same technique is applicable to an active matrix LCD employing MIM elements, as disclosed in Japanese Examined Patent Publication No. 63-6855. To reduce costs, the LCD television sets frequently employ low-number-of-bit A-D converters and a dithering technique to provide gradations.

FIG. 7 is a block diagram showing an LCD, according to a prior art, employing the dithering technique. The LCD has a 4-bit A-D converter 906. An image signal 902 is supplied to an analog input terminal AIN of the A-D converter 906, which converts the signal into 4-bit data. The 4-bit data is passed through a data bus 908 and is stored in a memory 910*a* of a signal electrode driver 910. A multiplexer 904 has a top switch 904*a* for switching high reference voltages Vt1 and Vt2 from one to another and a bottom switch 904*b* for switching low reference voltages Vb1 and Vb2 from one to another. The output of the switch 904*a* is connected to a high-reference-voltage input terminal Vrt of the A-D converter 906, and the output of the switch 904*b* is connected to a low-reference-voltage input terminal Vrb of the converter. The switches 904*a* and 904*b* are interlocked and controlled in response to a clock signal Φ1 provided by a controller 916.

The controller 916 provides the A-D converter 906 and driver 910 with a signal group Φ2 generated according to a horizontal synchronous signal. The signal group Φ2 includes a data sampling clock signal, a shift clock signal used to prepare an address of the memory 910*a*, a latch clock signal used to transfer data in the driver 910, and a timing signal used to carry out pulse-width modulation. The controller 916 provides a scanning electrode driver 912 with a signal group Φ3, which includes vertical scan signals such as a start signal for starting a scan operation and a clock signal for sequentially shifting a select pulse. The driver 910 consists of the memory 910*a* and a pulse-width modulator 910*b*. The output terminals of the driver 910 are connected to the signal electrodes of a liquid crystal panel 914, respectively. The output terminals of the driver 912 are connected to the scanning electrodes of the panel 914, respectively.

The memory 910*a* successively stores 4-bit data for one horizontal scan period and then transfers all stored data to the pulse-width modulator 910*b*. According to a line at a time scanning method generally used, the A-D converter 906 successively quantizes the image signal 902 for a first horizontal scan period into 4-bit data. The 4-bit data is stored in the memory 910*a*. In a second horizontal scan period, the 4-bit data for the first horizontal scan period is transferred to the modulator 910*b* in response to the latch clock signal of the signal group Φ2 provided by the controller 916. The modulator 910*b* carries out pulse-width modulation on the 4-bit data and provides drive signals to the signal electrodes of the panel 914. At this time, the driver 912 provides a select signal to a corresponding scanning electrode. As a result, a LCD driving voltage is applied to each pixel in the selected scan line to display a gradation. In the mean time, the A-D converter 906 successively quantizes the image signal 902 for the second horizontal scan period into 4-bit data, and the 4-bit data is stored in the memory 910*a*. These processes are repeated to display an image on the panel 914.

A dithering technique of realizing 32 gradations with the 4-bit A-D converter 906 will be explained. The image signal 902 supplied to the A-D converter 906 is, for example, a raster signal having a uniform luminance. The liquid crystal panel 914 has, for example, 240 scanning electrodes and is driven according to an NTSC method. The reference voltages are set as follows:

$$Vt1<Vt2$$

$$Vb1<Vb2$$

According to the NTSC method, the panel 914 is scanned from the top to the bottom in a period called a "field." The panel 914 is wholly scanned by two fields that form a "frame." In the first field, the panel 914 is scanned on every other line, and in the second field, on the remaining lines. The dithering technique expresses a gradation with a plurality of fields, and therefore, it halves the vertical resolution of an image.

In the first field, a combination of the high and low reference voltages Vt1 and Vb1 is used for converting an analog raster signal into digital data having a gradation "n," and voltages corresponding to the data are applied to pixels of the panel 914. In the second field, a combination of the high and low reference voltages Vt2 and Vb2 is used by the A-D converter 906 to convert the raster signal into digital data having a gradation "n" or "n-1." If the first and second fields display the gradation n, they are viewed as the gradation n. If the first field displays the gradation n and the second field the gradation n-1, they are averaged in human eyes and are viewed as a gradation "n-0.5." In this way, 0.5-interval gradations are realized, and the 4-bit A-D converter 906 achieves 32 gradations.

According to this prior art, the clock signal Φ1 for switching the reference voltage pairs from one to another alternates between high and low levels field for each field. When the polarity of a LCD driving voltage applied to one scanning electrode is opposite to the polarity of a LCD driving voltage applied to the adjacent scanning electrode and when the polarity of a LCD driving voltage applied to a given scanning electrode is inverted field by field, the period of inversion of the polarity of the LCD driving voltage agrees with the period of inversion of the clock signal Φ1. Consequently, the same reference voltage pair is always selected for any one of the polarities of the LCD driving voltage. When a raster signal is converted into two pieces of data having individual gradations that are different from each other by one level for the first and second fields, a LCD driving voltage applied to a given scanning electrode or a given pixel differs depending on the polarity of the LCD driving voltage. The difference is always in the same direction if the period of inversion of the polarity of the LCD driving voltage is the same as the period of inversion of the clock signal Φ1. This results in applying a direct-current voltage to the panel 914 to stick images into the panel.

SUMMARY OF THE INVENTION

To solve these problems of the prior art, an object of the present invention is to drive an LCD with an alternating current and display images having gradations on the LCD with the use of a low-number-of-bits A-D converter and a dithering technique employing two fields. This LCD cancels a direct-current voltage between the LCD driving voltages of different polarities applied to a liquid crystal panel of the LCD and prevents image sticking.

In order to accomplish the object, the present invention provides an LCD having an A-D converter and a liquid crystal panel. The LCD employs reference voltage pairs to display an image having gradations according to a dithering technique. The reference voltage pairs are switched in response to the logic value of a clock signal that is inverted field by field. According to a selected one of the reference voltage pairs, the A-D converter quantizes an image signal into display data. Drive signals corresponding to the display data are applied to the signal electrodes of the panel, and the scanning electrodes of the panel are sequentially selected, to thereby display an image, corresponding to the display data, on the panel. The polarity of a LCD driving voltage applied to a given scanning electrode is inverted field by field. The LCD employs a phase control signal to invert the phase of the clock signal according to which the reference voltage pairs are switched. The logic value of the phase control signal is changed to synchronize one of the reference voltage pairs with any one of the polarities of the LCD driving voltage. The LCD also has a unit for controlling the phase control signal so that the reference voltage pairs are evenly selected with respect to the polarities of the LCD driving voltage over a sufficiently long period.

The clock signal for switching the reference voltage pairs is periodically inverted to alternate the reference voltage pairs with respect to any one of the polarities of the LCD driving voltage. This technique cancels a voltage difference between the polarities of the LCD driving voltage due to the dithering operation, because the polarity of the LCD driving voltage difference is inverted when the reference voltage pairs are switched from one to another with respect to the polarity of the LCD driving voltage. The reference voltage pairs are evenly selected with respect to the polarities of the LCD driving voltage, to cancel a direct-current voltage applied to the panel, to thereby prevent images from being stuck into the panel.

DESCRIPTION OF THE PREFERRED EMBODIMENTS

Figure 1:
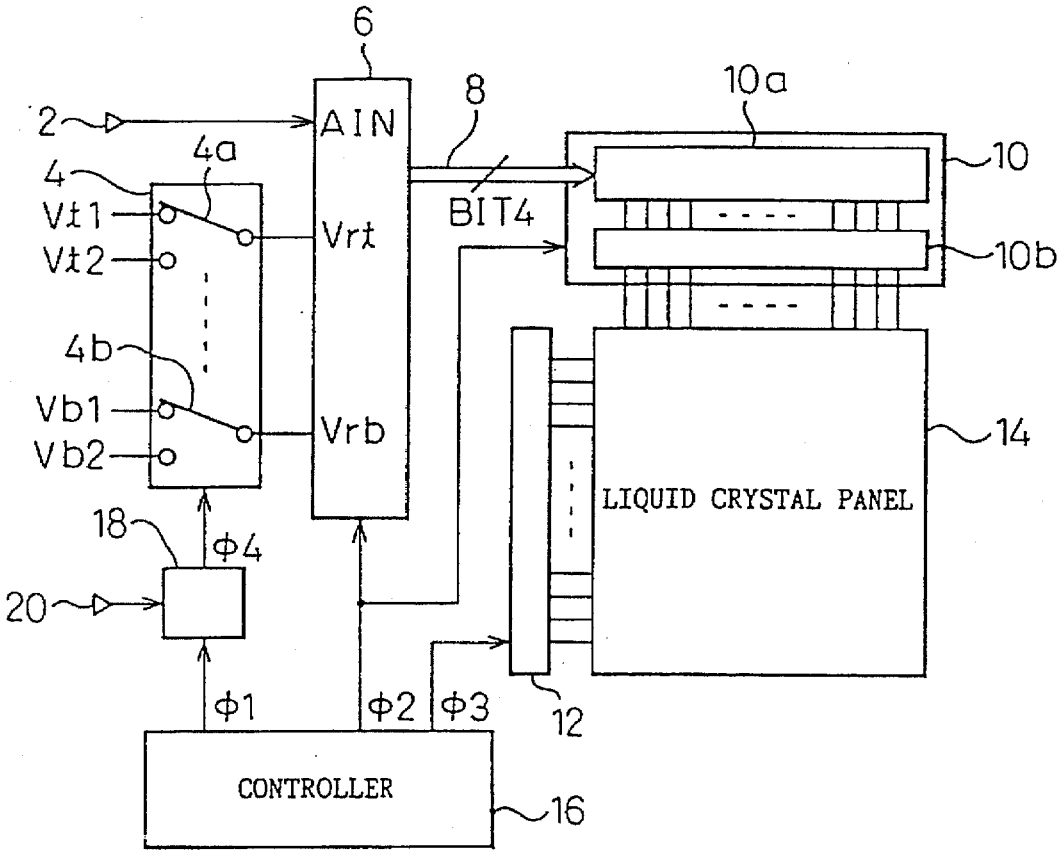
FIG. 1 is a block diagram showing an LCD according to an embodiment of the present invention.

An embodiment of the present invention will be explained with reference to FIGS. 1 to 6. FIG. 1 is a block diagram showing an LCD according to the embodiment. The LCD has a 4-bit A-D converter 6. A multiplexer 4 has a top switch 4*a* for selecting one of the high reference voltages Vt1 and Vt2 and supplying the selected one to a high-reference-voltage input terminal Vrt of the A-D converter 6. The multiplexer 4 also has a bottom switch 4*b* for selecting one of the low reference voltages Vb1 and Vb2 and supplying the selected one to a low-reference-voltage input terminal Vrb of the A-D converter 6. An image signal 2 is supplied to an analog input terminal AIN of the A-D converter 6, which provides 4-bit data according to the image signal 2. The 4-bit data is passed through a data bus 8 and is stored in a memory 10*a* of a signal electrode driver 10. The driver 10 has the memory 10*a* and a pulse-width modulator 10*b*. The output terminals of the driver 10 are connected to the signal electrodes of a liquid crystal panel 14, respectively. The output terminals of a scanning electrode driver 12 are connected to the scanning electrodes of the panel 14, respectively. A controller 16 provides a phase controller 18 with a clock signal Φ1, the driver 10 with a signal group Φ2 produced according to a horizontal synchronous signal, and the driver 12 with a vertical scan signal group Φ3. The phase controller 18 provides the multiplexer 4 with a clock signal Φ4 in response to a phase control signal 20.

Figure 2:
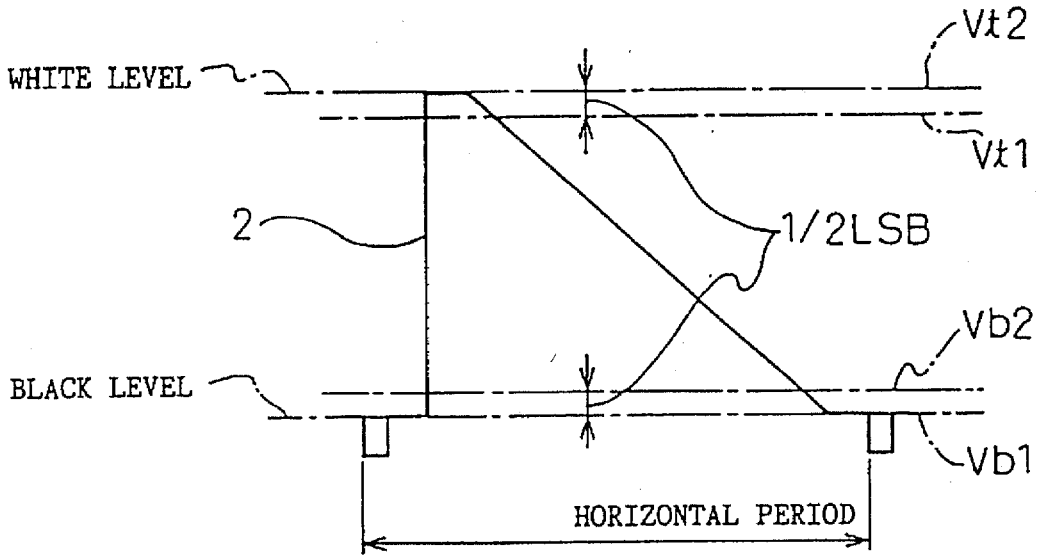
FIG. 2 explains high and low reference voltages according to the embodiment.

FIG. 2 explains the setting of the high and low reference voltages Vt1, Vt2, Vb1, and Vb2. The high and low reference voltages Vt2 and Vb2 are higher than the high and low reference voltages Vt1 and Vb1, respectively, by ½ LSB where LSB is the voltage resolution of the A-D converter 6. The high reference voltage Vt2 is adjusted to a white level of the image signal 2, and the low reference voltage Vb1 is adjusted to a black level of the image signal 2. The voltages Vt2 and Vb2 may be lower than the voltages Vt1 and Vb1, respectively. In this case, the high reference voltage Vt1 is adjusted to the white level, and the low reference voltage Vb2 is adjusted to the black level. The high and low reference voltages Vt1 and Vb1 form a reference voltage pair Vt1-Vb1, and the voltages Vt2 and Vb2 form a reference voltage pair Vt2-Vb2. These pairs are periodically switched from one to another to display an image having gradations according to the dithering technique.

Figure 3:
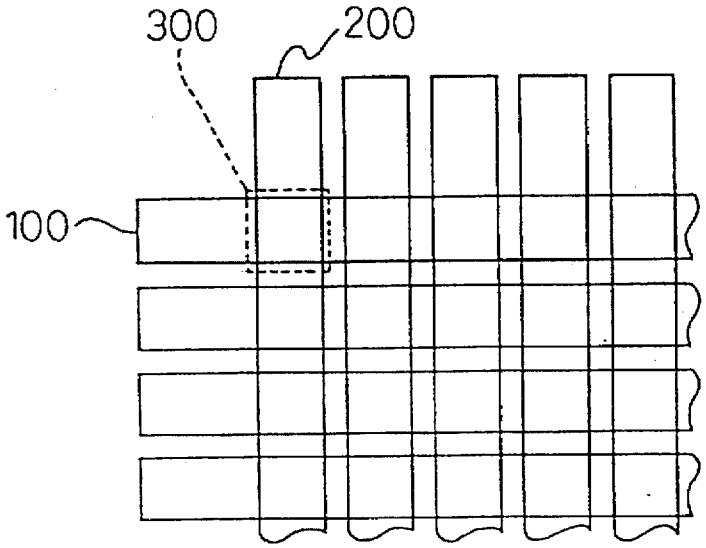
FIG. 3 is an enlarged view showing the upper left corner of a liquid crystal panel according to the embodiment.

FIG. 3 is an enlarged view showing a left upper part of the panel 14. A pixel 300 is at the intersection of a scanning electrode 100 and a signal electrode 200. Scanning electrodes for each field are selected one after another from the top of the panel 14. Adjacent scanning electrodes receive drive voltages having opposite polarities. The polarity of a LCD driving voltage applied to a given scanning electrode is inverted field by field.

Figures 4A, 4B, 4C, 4D, 4E, 4F, 4G:
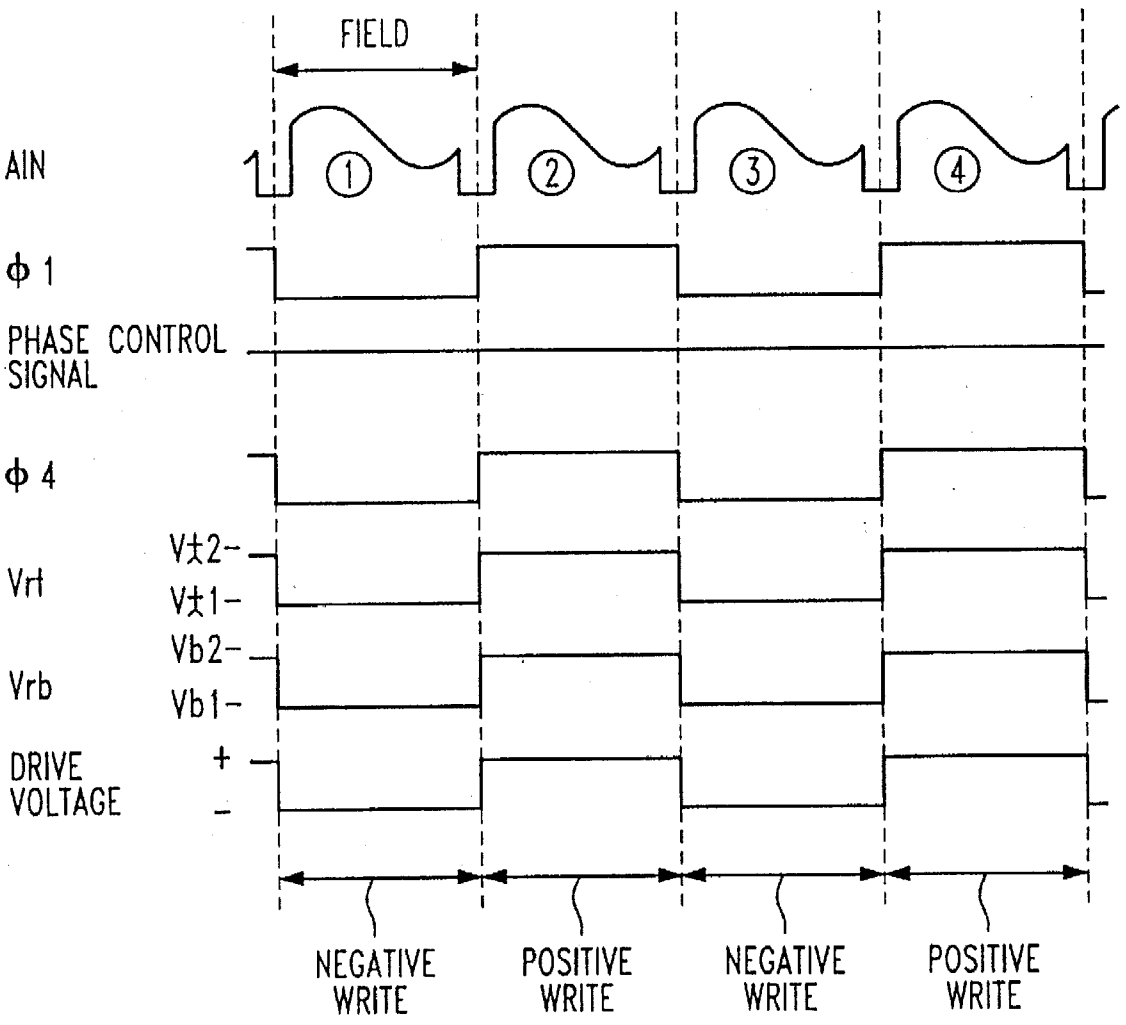
FIG. 4 is a timing chart showing the operation of the embodiment.
Figures 5H, 5I, 5J, 5K, 5L, 5M, 5N:
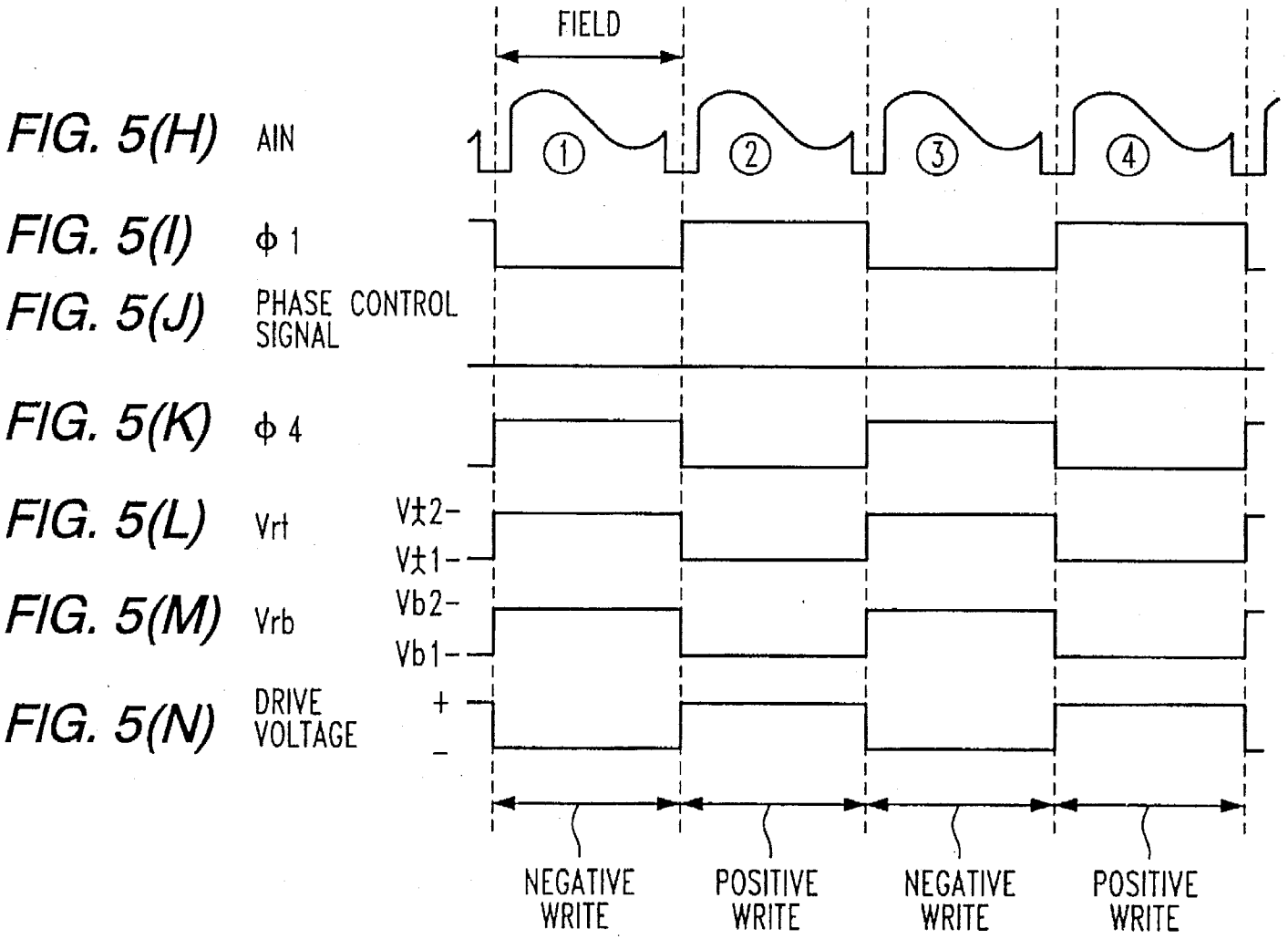
FIG. 5 is a timing chart showing the operation of the embodiment.

FIGS. 4 and 5 are timing charts explaining the operation of the embodiment. In (A) to (G) of FIG. 4, the phase control signal 20 is at high level. "AIN" in (A) of FIG. 4 represents the image signal 2 supplied to the A-D converter 6. Reference marks (1), (2), (3), and (4) of (A) in FIG. 4 are field numbers. The clock signal Φ1 of (B) in FIG. 4 alternates between high and low levels field by field. The phase control signal 20 of (C) in FIG. 4 is at high level. The clock signal Φ4 of (D) in FIG. 4 is provided by the phase controller 18. In FIG. 4, (E) shows the potential of a high reference voltage Vrt to the A-D converter 6. The voltage Vrt is one of the high reference voltages Vt1 and Vt2 selected by the top switch 4*a* of the multiplexer 4. In FIG. 4, (F) shows the potential of a low reference voltage Vrb to the A-D converter 6. The voltage Vrb is one of the low reference voltage Vb1 and Vb2 selected by the bottom switch 4*b* of the multiplexer 4. In FIG. 4, (G) shows the polarity of a LCD driving voltage applied to the top (first) scanning electrode of the panel 14.

When the polarity of the LCD driving voltage is positive, it is indicated that the field carries out a positive write operation (+ write operation), and when the polarity of the LCD driving voltage is negative, it is indicated that the field carries out a negative write operation (– write operation). In + write operation, a voltage during the period when the scanning electrode is selected is higher than a voltage during the period when the scanning electrode is not selected. In – write operation, a voltage during the period when the scanning electrode is selected is lower than a voltage during the period when the scanning electrode is not selected.

In (H) to (N) of FIG. 5, the phase control signal 20 is at low level. Reference marks in this figure are the same as those of FIG. 4. Namely, "AIN" of (H) in FIG. 5 represents the image signal 2 supplied to the A-D converter 6. Reference marks (1) to (4) of (H) in FIG. 5 are field numbers. In FIG. 5, (I) shows the clock signal Φ1, (J) shows the phase control signal 20 at low level, and (K) shows the clock signal Φ4. In FIG. 5, (L) shows the potential of the high reference voltage Vrt at the A-D converter 6, and (M) shows the potential of the low reference voltage Vrb at the A-D converter 6. In FIG. 5, (N) shows the polarity of a LCD driving voltage applied to the first scanning electrode of the panel 14.

In FIGS. 4 and 5, the clock signal Φ1 is at low level in the odd fields (1) and (3) and is at high level in the even fields (2) and (4). When the phase control signal 20 is at high level as shown in FIG. 4, the phase of the clock signal Φ4 provided by the phase controller 18 agrees with the phase of the clock signal Φ1. When the phase control signal 20 is at low level as shown in FIG. 5, the phase of the clock signal Φ4 is opposite to the phase of the clock signal Φ1. Namely, the logic value of the phase control signal 20 is changed from high to low, or from low to high, to invert the phase of the clock signal Φ4. The clock signal Φ4 is supplied to the multiplexer 4 to switch the reference voltage pairs. If the clock signal Φ4 is at low level, the multiplexer 4 selects the reference voltages Vt1 and Vb1, which are supplied to the input terminals Vrt and Vrb of the A-D converter 6, respectively. According to these reference voltages, the A-D converter 6 converts the image signal 2 into 4-bit digital data. If the clock signal Φ4 is at high level, the multiplexer 4 selects the reference voltages Vt2 and Vb2 according to which the A-D converter 6 converts the image signal 2 into 4-bit digital data. The polarity of the LCD driving voltage applied to the first scanning electrode of the panel 14 is set to carry out a negative write operation in the odd fields (1) and (3) and a positive write operation in the even fields (2) and (4).

Figures 6A, 6B, 6C, 6D, 6E:
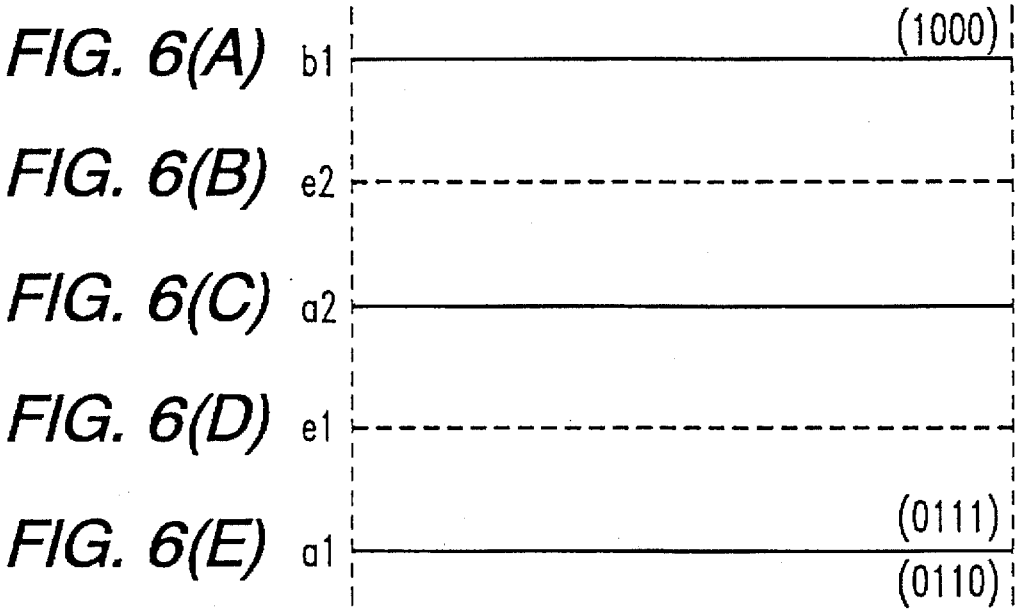
FIG. 6 explains the relationship between a comparison voltage and an input voltage in an A-D converter according to the embodiment.
Figure 7:
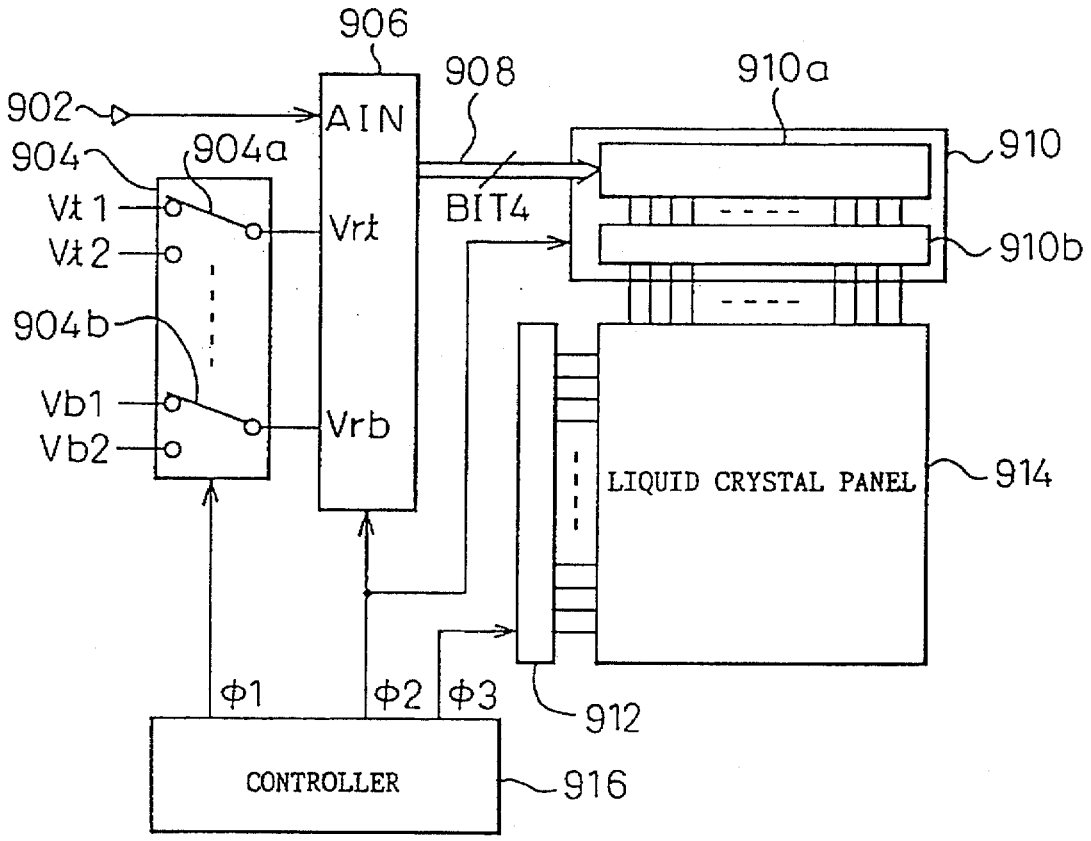
FIG. 7 is a block diagram showing an LCD according to a prior art.

FIG. 6 explains the relationship between a comparison voltage that is formed according to one of the reference voltage pairs Vt1-Vb1 and Vt2-Vb2 and the voltage of the image signal 2. This embodiment equally divides the difference between the high and low reference voltages by 14, to provide comparison voltages used by the A-D converter 6 to quantize the image signal 2. When the reference voltage pair Vt1-Vb1 is selected for quantization, a comparison voltage a1 sets a border between the sixth (0110) and seventh (0111) gradations, and a comparison voltage b1 sets a border between the seventh (0111) and eighth (1000) gradations. The comparison voltage a1 is the sixth potential from the bottom when the difference in the reference voltage pair is equally divided by 14. When the reference voltage pair Vt2-Vb2 is used for quantization, a comparison voltage a2 sets a border between the sixth and seventh gradations. The high and low reference voltages are set as follows;

$$Vt1<Vt2$$

$$Vb1<Vb2$$

Accordingly, the following relationship is established:

$$a1<a2<b1$$

The waveform of the image signal 2 has heights of, for example, e1 and e2 that have the following relationship with respect to the comparison voltages a1, a2, and b1:

$$a1<e1<a2<e2<b1$$

When the phase control signal 20 is at high level as shown in FIG. 4, the wave height e1 for a given odd field is quantized according to the comparison voltage a1. Since the wave height e1 is higher than the comparison voltage a1 and lower than the comparison voltage b1, the seventh gradation is selected. The wave height e1 for a given even field is quantized according to the comparison voltage a2. Since the wave height e1 is lower than the comparison voltage a2, the sixth gradation is selected. When the phase control signal 20 is at low level as shown in FIG. 5, the wave height e1 for a given odd field is quantized according to the comparison voltage a2, and therefore, the sixth gradation is selected. Similarly, the wave height e1 for a given even field is quantized according to the comparison voltage a1, and therefore, the seventh gradation is selected. In this way, the seventh and sixth gradations are displayed in the first and second fields whatever the level of the phase control signal 20 is. These gradations are visually averaged into a gradation 6.5. In the case of the wave height e2, it is higher than the comparison voltages a1 and a2 and lower than the comparison voltage b1. Accordingly, the seventh gradation is displayed in each of the odd and even fields whatever the level of the phase control signal 20 is. As a result, the seventh gradation is viewed. The first scanning electrode carries out a negative write operation in each odd field and a positive write operation in each even field. Table 1 shows the relationship between the polarity of a LCD driving voltage and a gradation to be displayed.

TABLE 1

| Phase control signal<br>Field | Odd | High<br>Even | High<br>Odd | Low<br>Even | Low |
|---|---|---|---|---|---|
| Gradation for e1 | | 7 | 6 | 6 | 7 |
| Gradation for e2 | | 7 | 7 | 7 | 7 |
| Drive polarity<br>(Write mode) | – | + | – | + | |

As shown in Table 1, the field that displays the lower gradation is fixed to one of the polarities of the LCD driving voltage, if the phase control signal 20 is fixed to high or low level. In this case, a write operation carried out with one of the polarities of the LCD driving voltage is always stronger than another write operation carried out with the other polarity of the LCD driving voltage. This results in causing a LCD driving voltage difference depending on the polarity of the LCD driving voltage, to apply a direct-current voltage to the panel 14. On the other hand, if the logical value of the phase control signal 20 is periodically alternated, the field that displays the lower gradation alternates with respect to any one of the polarities of the LCD driving voltage. In this case, the panel 14 may receive a direct-current voltage for a short period but the polarity of the direct-current voltage is inverted when the logic value of the phase control signal 20 is changed. As a result, the direct-current voltage is canceled. Namely, no direct-current voltage occurs over a longer period.

Changing the logic value of the phase control signal 20 is used to cancel the direct-current voltage applied to the panel 14. Therefore, it is preferable to equalize the periods of high and low levels of the phase control signal 20 with each other. If these periods are too short, however, it will cause flickering. According to our experiments, the periods are each about one minute to cause no flickering and cancel the direct-current voltage.

The easiest way to control the logic value of the phase control signal 20 is to periodically change the same. It is possible to employ a random number generator to change the logic value of the phase control signal 20 at random. The logic value of the phase control signal 20 may be periodically changed by counting pulses of the clock signal Φ1. This technique is easy to realize with the controller 16.

Figure 8:
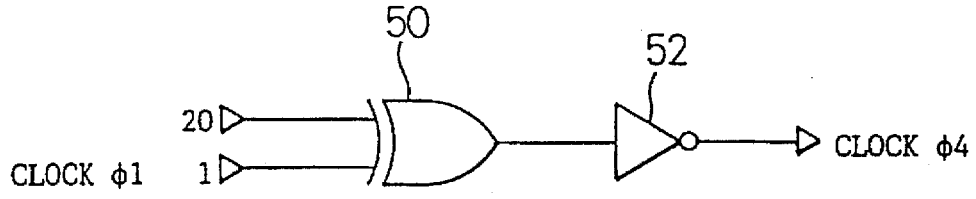
FIG. 8 shows a phase controller 18 of the LCD according to the embodiment.

FIG. 8 shows an example of the phase controller 18 of FIG. 1.

The phase controller 18 consists of an EXOR circuit 50 and a NOT circuit 52.

The EXOR circuit 50 receives the clock signal Φ1 and phase control signal 20 and provides the NOT circuit 52 with an exclusive OR of the two signals. The NOT circuit 52 logically inverts the same and provides the clock signal Φ4.

When the phase control signal 20 is at high level, the phase of the clock signal Φ4 agrees with the phase of the clock signal Φ1, and when the phase control signal 20 is at low level, the phase of the clock signal Φ4 is opposite to the phase of the clock signal Φ1, as shown in FIGS. 4 and 5.

The NOT circuit 52 may be omitted to use the output of the EXOR circuit 50 as the clock signal Φ4. In this case, the phase of the clock signal Φ4 is opposite to the phase of the clock signal Φ1 when the phase control signal 20 is at high level, and agrees with the phase of the clock signal Φ1 when the phase control signal 20 is at low level, contrary to FIGS. 4 and 5. The effect of this arrangement, however, is the same as that of the embodiment mentioned above.

Figure 9:
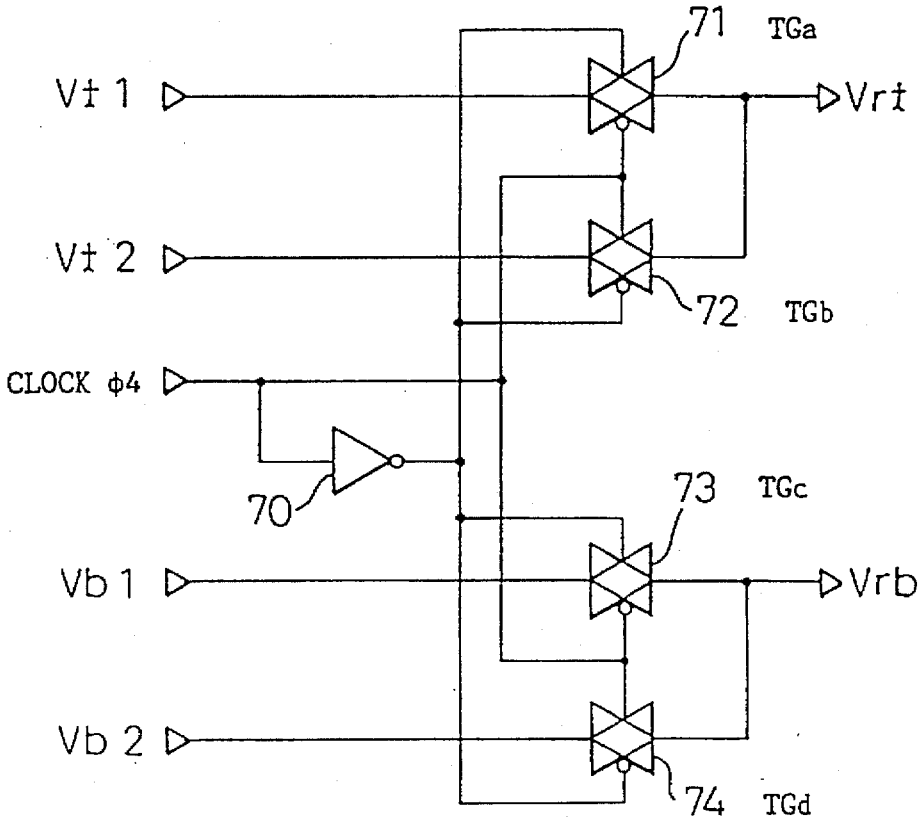
FIG. 9 shows a multiplexer 4 of the LCD according to the embodiment.

FIG. 9 shows an example of the multiplexer 4 of FIG. 1. Transfer-gates-a(TGa) 71 and TGb 72 form the top switch 4*a* of the multiplexer 4, and transfer gates TGc 73 and TGd 74 form the bottom switch 4*b* thereof.

When the clock signal Φ4 is at low level, the TGa 71 and TGc 73 are ON, and the TGb 72 and TGd 74 are OFF, to select the reference voltage pair Vt1-Vb1. When the clock signal Φ4 is at high level, the TGb 72 and TGd 74 are ON, and the TGa 71 and TGc 73 are OFF, to select the reference voltage pair Vt2-Vb2.

In this way, the high and low reference voltages are interlocked and switched according to the logic value of the clock signal Φ4.

The multiplexer 4 is not limited to that of FIG. 9. It may have any arrangement if the top and bottom switches 4*a* and 4*b* are interlocked and switched according to the clock signal Φ4.

According to this embodiment, the reference voltage pairs are switched field by field, and the same reference voltage pair is selected for all scanning electrodes in a given field. It is possible to select different reference voltage pairs for a given scanning electrode field by field, and in each field, different reference voltage pairs may be selected for respective scanning electrodes. A direct current voltage is applied to the liquid crystal panel 14 for each of the scanning electrode since the same reference voltage pair is selected for one of the polarity of the LCD driving voltage. Contrary to this, the direct-current voltage is canceled when the logic value of the phase control signal 20 is inverted to select the other reference voltage pair and apply a direct-current voltage of opposite polarity to the panel 14.

The present invention controls a LCD driving voltage in a conventional manner and periodically alternates reference voltage pairs with respect to any one of the polarities of the LCD driving voltage. It is possible to select reference voltage pairs in a conventional manner and periodically alternate the polarities of a LCD driving voltage.

As explained above, the present invention provides an LCD that alternately selects one of two reference voltage pairs in response to a clock signal that is inverted in response to a phase control signal, to achieve a dithering operation employing two fields. Since the reference voltage pairs are alternated with respect to any one of the polarities of a LCD driving voltage applied to the LCD, a direct-current voltage due to a voltage difference between the polarities of the LCD driving voltage is canceled, and images are not stuck into a liquid crystal panel of the LCD. The phase control signal may be provided externally so that the period and waveform thereof are optionally set according to the characteristics of the liquid crystal panel.

We claim:

1. A liquid crystal display, comprising, an analog-to-digital converter;

a liquid crystal panel having signal and scanning electrodes;

means for switching at least two reference voltages from one to another at first intervals for input to the analog-to-digital converter to quantize an analog image signal into display data according to a dithering technique;

means for using the display data to prepare signals applied to the signal electrodes of the panel;

means for applying a select signal to the scanning electrodes, the signals applied to the signal and scanning electrodes of the panel having alternate polarities to display on the panel an image with gradations,;

said at least two reference voltages being divided into two groups, each of said two groups being alternately synchronized with one of the polarities of the select signal applied to one of the scanning electrodes at second intervals, each of said second intervals being two times longer than each of the first intervals at which the at least two reference voltages are switched from one to another.

2. A liquid crystal display, comprising;

an analog-to-digital converter;

a liquid crystal panel having signal and scanning electrodes;

means for switching at least two reference voltages from one to another at first intervals for input to the analog-to-digital converter to quantize an analog image signal into display data according to a dithering technique;

means for using the display data to prepare signals applied to the signal electrodes of the panel;

means for applying a select signal to the scanning electrodes, the signals applied to the signal and scanning electrodes of the panel having alternate polarities to display on the panel an image with gradations,;

said at least two reference voltages being divided into two groups, each of said two groups being alternately synchronized with one of the polarities of the select signal applied to one of the scanning electrodes at random intervals, each of said random intervals being two times longer than each of the first intervals at which the at least two reference voltages are switched from one to another.

3. The liquid crystal display of claim 1 wherein the at least two reference voltages comprise two reference voltage pairs.

4. The liquid crystal display of claim 2 wherein the at least two reference voltages comprise two reference voltage pairs.

* * * * *